United States Patent [19]

Novoa et al.

[11] 4,248,624

[45] Feb. 3, 1981

[54] USE OF PREREDUCED ORE IN A BLAST FURNACE

[75] Inventors: Jorge O. B. Novoa, Garza Garcia; Julian S. Ramirez, Monterrey, both of Mexico

[73] Assignee: Hylsa, S.A., Monterrey, Mexico

[21] Appl. No.: 33,692

[22] Filed: Apr. 26, 1979

[51] Int. Cl.[3] ..... C21B 5/00

[52] U.S. Cl. ..... 75/41

[58] Field of Search ..... 75/41, 42, 34, 35, 38

[56] References Cited

U.S. PATENT DOCUMENTS

| | | | |
|---|---|---|---|
| 1,945,341 | 1/1934 | Brassert | 75/41 |
| 1,991,008 | 2/1935 | Brassert | 75/41 |
| 2,778,018 | 1/1957 | Strassburger | 75/41 |
| 3,218,155 | 11/1965 | Strassburger | 75/42 |
| 3,282,678 | 11/1966 | Melcher et al. | 75/41 |
| 4,046,556 | 9/1977 | Celada et al. | 75/35 |
| 4,111,687 | 9/1978 | Syska | 75/48 |

OTHER PUBLICATIONS

Esparza et al. *Latin American Institute of Iron & Steel,* (ILAFA), pp. 359 to 367, Aug. 1978.

Graff et al., Journal of Metals, pp. 389 to 394, Apr. 1965.

Maschlanka et al., Metallurgical Plant and Technology, pp. 13 to 20, Feb. 1978.

*Primary Examiner*—M. J. Andrews

*Attorney, Agent, or Firm*—Curtis, Morris & Safford

[57] ABSTRACT

An improved method for operating a blast furnace wherein a portion of the charge is prereduced iron ore with a relatively low metallization in the range of 75% to 90% and a relatively high carbon content in the range of 1.5% to 4.5% by weight. The composition of the sponge iron is selected so as to realize an increase in the production of pig iron and a decrease in the consumption of coke while simultaneously maximizing the over-all economy and efficiency of the blast furnace operation. In a preferred embodiment of the invention at least 80% by weight of the carbon content in the sponge iron used as a portion of the charge to the blast furnace is in the form of ferric carbide.

6 Claims, 2 Drawing Figures

USE OF PREREDUCED ORE IN A BLAST FURNACE

BACKGROUND OF THE INVENTION

Figure 1:
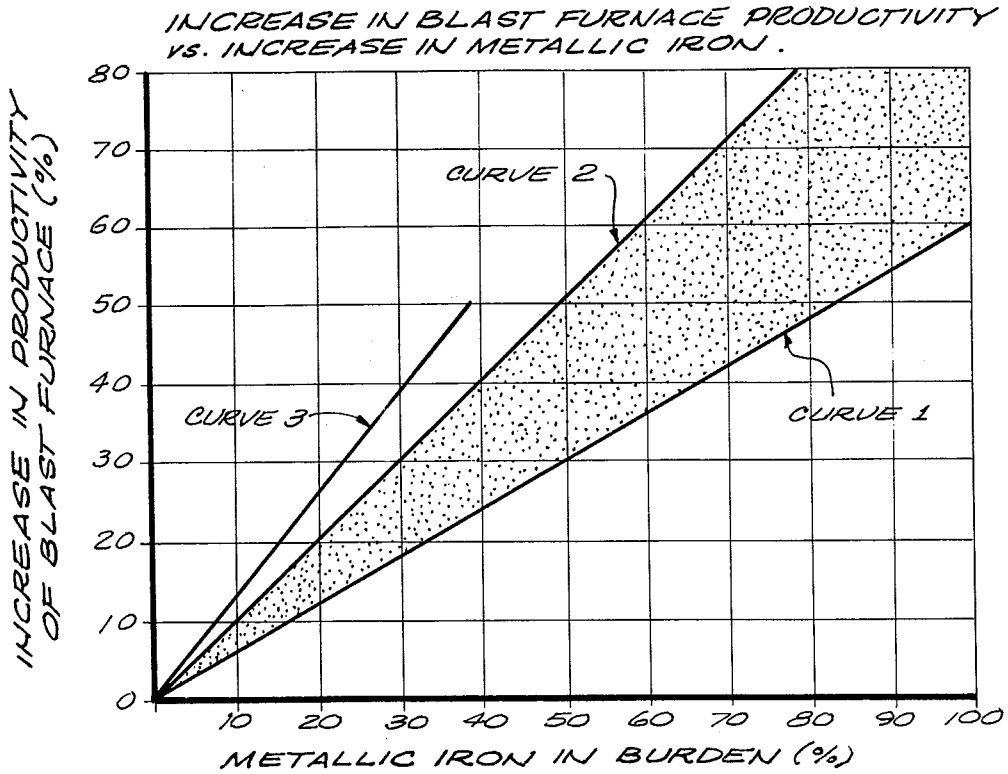

This invention relates to an improved method of operating a blast furnace, and more particularly, to a method of operating the blast furnace in which a part of the usual iron ore feed to the furnace is replaced by prereduced iron ore having a relatively low metallization and a relatively high carbon content. Through the use of prereduced iron ore, both a decrease in the coke requirement and an increase in the overall productivity of the blast furnace is achieved. In the following description, the process is illustratively described as applied to the use of a charge of a prereduced iron ore which is sponge iron. However, as the description proceeds, it will be evident to those skilled in the art that the invention is also applicable to a process that uses prereduced iron ores other than sponge iron obtained from the direct reduction of iron ore.

In general, the production of pig iron in a blast furnace involves charging iron bearing material (iron ore, sinter, pellets, iron or steel scrap, etc.), carbonaceous material as fuel (coke), and flux (limestone or dolomite) into the top of the furnace. A blast of heated air is blown through tuyeres mounted in the bosh into the upper portion of the furnace hearth. A portion of the fuel is burned by the blast air to produce heat for the necessary chemical reactions involved and also for melting the iron. The balance of the fuel and a portion of the gas of combustion is utilized to reduce the iron ore descending through the blast furnace. Typically, in the upper portion of the blast furnace, the unreduced iron ore is partially reduced from $FE_2O_3$ (hematite) to FeO (wustite) by the upwardly flowing hot gaseous products from the combustion zone located in the lower portion of the blast furnace. The amount of coke required to supply heat to the blast furnace and to effectuate reduction of the unreduced iron ore is a direct function of the amount and composition of the feed charged to the blast furnace and the desired pig iron production.

In previously proposed processes, the productivity of blast furnaces has been increased through a modification of the burden charged to the blast furnace. The use of prereduced iron ore as part of the charge to a blast furnace has been generally disclosed. However, substantially all of the previously proposed processes charged a highly metallized prereduced iron ore into the blast furnace. It was believed that if the metallization and therefore the metallic iron content of the charge is increased to the highest value possible, the amount of reduction required in the blast furnace could be correspondingly decreased. Therefore, there would be an increase in the productivity of the blast furnace and a decrease in the coke consumption since less coke would be needed to reduce the already partially prereduced iron ore in the charge.

None of the improvements previously suggested have adequately addressed the important overall energy consumption and process efficiency considerations. The need for a higher metallization of prereduced iron ore must be balanced against the greater difficulty and expense of obtaining highly metallized sponge iron as compared to sponge iron with a lower metallization. It has been found that the effect of charginga blast furnace with sponge iron of low metallization and high carburization on the economy and efficiency of the overall blast furnace operation has not been adequately considered.

A need exists for an improved blast furnace operation which will both significantly increase the production of pig iron and decrease the coke consumption while simultaneously maximizing overall economy and efficiency in the production of the prereduced iron ore used as part of the charge to the blast furnace.

SUMMARY OF THE INVENTION

It is accordingly an object of the present invention to provide an improved method for the production of pig iron in a conventional blast furnace wherein the production of pig iron is increased while the coke consumption of the process is decreased to a greater extent than in prior processes.

It is another object of the invention to provide an improved method for the production of pig iron in a conventional blast furnace wherein the production of pig iron is increased while the coke consumption of the process is descreased to a greater extent than in prior processes.

It is another object of the invention to provide an improved method for the production of pig iron in a blast furnace that is more economical and efficient than heretofore known processes.

It is a further object of the invention to provide an improved method for the production of pig iron in a blast furnace with an improved productivity and a decrease in the consumption of coke by utilizing as a substantial part of the furnace charge sponge iron with relatively high carbon content and relatively low metallization.

It is still a further object of the invention to provide a method for operating a blast furnace wherein part of the charge is sponge iron with a composition which is so selected that it contributes substantially to the reduction of the iron ore in the charge while simultaneously maximizing the overall economy and efficiency of the blast furnace operation.

GENERAL DESCRIPTION

The objects and advantages of the present invention may be generally achieved by using as a portion of the charge to a blast furnace sponge iron having a metallization of from 75% to 90% and a carbon content of 1.5 to 4.5% by weight with at least 80% of the carbon content of the sponge iron being in the form of ferric carbide ($Fe_3C$).

The ratio of ferric carbide to free carbon in sponge iron depends on several parameters such as the type of ore and reducing gas and the conditions of the process. A particularly preferred method of the invention involves charging sponge iron wherein at least 90% of the total carbon content is ferric carbide.

A mixture of sponge iron having such a composition and unreduced iron ore is charged to the top of the blast furnace. As the burden moves downwardly through the blast furnace, it is heated to a suitable temperature at which the ferric carbide ($Fe_3C$) in the sponge iron can reduce the residual iron oxide in the sponge iron. The carbon monoxide produced in the reduction of the residual iron oxide in the sponge iron combines with the carbon monoxide obtained from the addition of coke to effectuate the partial reduction of hematite ($Fe_2O_3$) or magnetite ($Fe_3O_4$) to wustite (FeO). These reduction reactions proceed in accordance with the following equations:

$$FeO + Fe_3C \rightarrow 4Fe^{\circ} + CO$$

$$Fe_2O_3 + CO \rightarrow 2FeO + CO_2$$

$$Fe_3O_4 + CO \rightarrow 3FeO + CO_2$$

In the conventional operation of the blast furnace, all of the carbon monoxide used to effectuate reduction of any iron oxides present in the charge must be supplied by the coke added to the blast furnace. Through this invention, the amount of carbon monoxide which must be supplied by the coke to achieve the desired reduction is decreased.

Therefore, an important advantage of the present invention is in the fact that by charging sponge iron which is highly carburized, the amount of coke which must be charged to the blast furnace to reduce the iron ore is decreased in proportion to the amount of prereduced ore and ferric carbide.

Another important advantage of the present invention wherein sponge iron with a low metallization in the range of 75 to 90%, or preferably 75 to 85% is used, is that lower levels of metallization can be more economically and efficiently achieved in the prereduction of iron ore. As shown in Table 1 below, an increase of almost 30% in the total yield of sponge iron in the sponge iron production plant is realized when operating at 75% metallization as compared to 90% metallization. Operating at a lower metallization allows for greater productivity and thermal efficiency since the residence time of the ore through a direct reduction reactor is less and the operating temperatures are lower.

TABLE 1.

| Daily output (tons) of a Direct Reduction Plant | | | | |
|---|---|---|---|---|
| Metallization | 75% | 80% | 85% | 90% |
| Sponge Iron | 1180 | 1090 | 1000 | 910 |
| Total Iron | 992.5 | 939.14 | 883.6 | 814.4 |
| Metallic Iron | 744.34 | 751.34 | 751.1 | 732.9 |
| Carbon | 53.1 | 37.06 | 22 | 12.7 |
| Gangue | 63.48 | 60.06 | 56.5 | 57.1 |

The carbon content of the sponge iron may range from 1.4 to 4.5 weight percent when in the 75% to 90% metallization range. A particularly preferred method of the invention involves charging sponge iron with a carbon content of 3 to 4.5 weight percent. The sponge iron charged to the blast furnace should also have a minimum carburization in the form of ferric carbide ($Fe_3C$). Of the total carbon content of the sponge iron, at least 80%, and preferably 90%, should be in the form of ferric carbide. When the sponge iron with low metallization and high carburization is charged to the upper portion of the blast furnace, the residual iron oxide is reduced by the ferric carbide thereby rendering the entire charge of sponge iron essentially all metallic. This secondary reduction taking place in the blast furnace represents a direct savings in the energy requirements necessary to increase the metallization from 75% to some higher value of metallization. Additionally, since more sponge iron with a lower metallization can be produced in a given time, the productivity of the reduction plant is increased.

In Table 2 a material balance is presented for sponge iron metallization rates in the range of 75% to 90%. The carbon present in the sponge iron charged to the blast furnace ranges from 1.4 weight per cent at 90% metallization to 4.5% at 75% metallization. The data presented shows that while the amount of metallic iron present in sponge iron with 75% metallization is considerably less than in sponge iron with 90% metallization, the total iron present is substantially the same.

TABLE 2.

| Composition (%) of Sponge Iron Obtained in a Direct Reduction Plant | | | | | |
|---|---|---|---|---|---|
| Metallization | Iron Ore | 75% | 80% | 85% | 90% |
| Total Iron | 67 | 84.11 | 86.6 | 88.36 | 89.49 |
| Carbon | 0 | 4.5 | 3.4 | 2.21 | 1.40 |
| Oxygen | 28.7 | 6.01 | 4.92 | 3.79 | 2.56 |
| Gangue | 4.3 | 5.38 | 5.51 | 5.65 | 6.27 |
| Metallic Iron | 0 | 63.08 | 68.93 | 75.11 | 80.54 |

SPECIFIC DESCRIPTION

Tests have been conducted to determine to what extent productivity in a blast furnace could be increased while simultaneously decreasing the coke consumption when using sponge iron as part of the charge. In general, prior art processes used sponge iron with high metallization as compared to sponge iron with low metallization and high carburization used in accordance with the present invention. The results of these tests are set forth in FIGS. 1 and 2.

In FIG. 1, a set of curves are presented to illustrate how the productivity of the blast furnace increases as a function of an increase in the metallic iron in the burden. The shaded area between curves 1 and 2 represents the results obtained in prior art processes wherein a portion of the charge to the blast furnace was prereduced ore. These results indicate that productivity of a blast furnace can be increased from about 6% to 10% per 10% increase of metallic iron in the burden.

Curve 3 of FIG. 1 represents the increase in productivity of the blast furnace realized when using sponge iron with low metallization and high carburization as part of the charge to the blast furnace. These results tend to indicate that when using sponge iron in accordance with the present invention, the average increase in productivity of the blast furnace over the prior art processes is about 9%.

Figure 2:
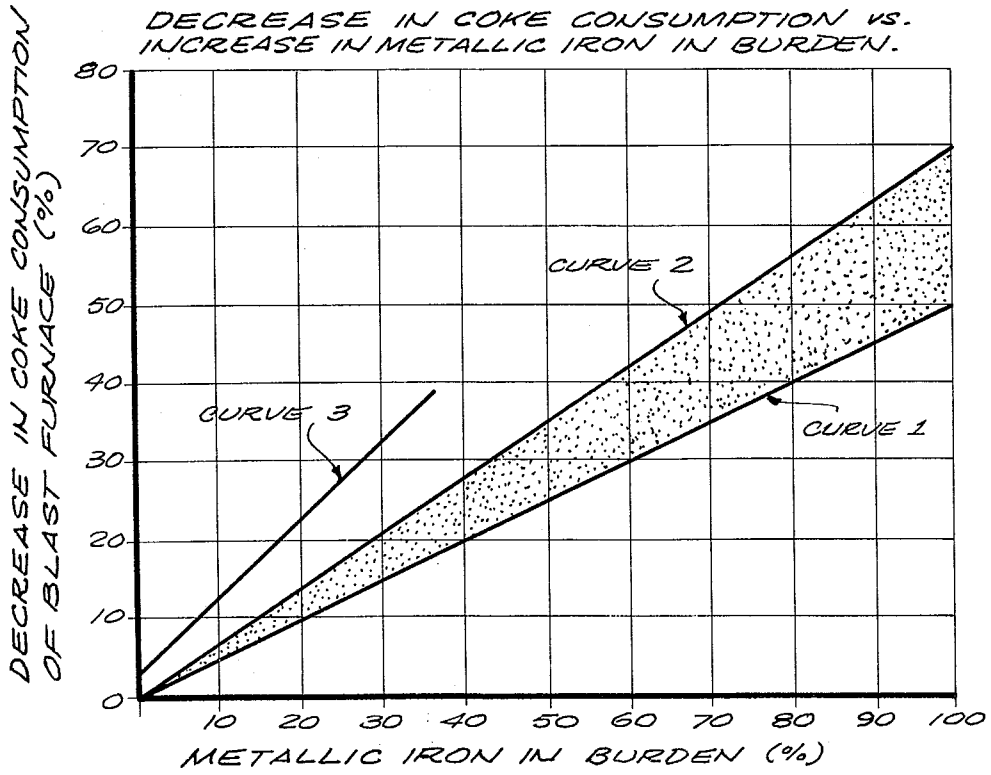

In FIG. 2, another set of curves is presented which illustrates how the coke consumption in a blast furnace changes as a function of the change in metallic iron in the burden. The shaded area between curves 1 and 2 represents the results obtained in prior art processes and suggests that the coke consumption can be decreased about 5% to 7% per 10% increase of metallic iron in the burden.

Curve 3 represents the results obtained when using sponge iron with low metallization and high carburization. The results indicate that the coke consumption can be decreased about 7% over the prior art processes.

A summary of a series of tests in which the amount of sponge iron contained in the charge to the blast furnace ranged from 0% to 35% is set forth in Tables 3 and 4 below. The tests were conducted to determine the amount of pig iron produced and the amount of coke consumed in the blast furnace when charging different amounts of sponge iron with a composition in accordance with the present invention.

TABLE 3.

| Composition of Sponge Iron Charged to the Blast Furnace (%) | | | | |
|---|---|---|---|---|
| | 0% Sponge Iron | 15% Sponge Iron | 25% Sponge Iron | 35% Sponge Iron |
| Total Fe | — | 86.9 | 87.10 | 86.77 |
| Metallic Fe | — | 73.2 | 73.8 | 72.2 |
| FeO | — | 17.7 | 17.66 | 18.74 |
| $SiO_2$ | — | 1.71 | 1.66 | 1.76 |
| $Al_2O_3$ | — | 0.80 | 0.89 | 0.81 |
| CaO | — | 1.84 | 1.80 | 1.64 |
| MgO | — | 0.98 | 1.0 | 0.91 |
| C | — | 2.23 | 2.36 | 2.33 |

The material used and the test conditions are set forth in Table 4.

TABLE 4.

| Operating Parameters of the Blast Furnace | | | | |
|---|---|---|---|---|
| | 0% Sponge Iron | 15% Sponge Iron | 25% Sponge Iron | 35% Sponge Iron |
| Materials Charged | | | | |
| (Kg/Ton of Pig Iron) | | | | |
| Sinter | 1,048 | 1,047 | 957 | 853 |
| Lump Ore | 675 | 443 | 238 | 74 |
| Sponge Iron | — | 266 | 400 | 494 |
| Coke | 704 | 604 | 546 | 491 |
| Dolomite | 135 | 81 | 53 | 34 |
| Blast Air | | | | |
| Volume of Blast Air ($Nm^3$/min) | 1,456 | 1,511 | 1,478 | 1,467 |
| Humidity ($g/M^3$) | 23.5 | 28.8 | 29.3 | 31.1 |
| Temperature (°C.) | 787 | 802 | 808 | 809 |
| Pressure ($Kg/cm^2$) | 1.47 | 1.41 | 1.33 | 1.30 |
| Pig Iron Product | | | | |
| Tons/day | 779 | 972 | 1,065 | 1,165 |
| Temperature (°C.) | 1,340 | 1,417 | 1,407 | 1,390 |
| Silicon (%) | 1.08 | 1.17 | 0.98 | 1.05 |
| Sulfur (%) | 0.083 | 0.048 | 0.058 | 0.071 |
| Slag | | | | |
| Amount (Kg/Ton Pig Iron) | 395 | 344 | 332 | 280 |
| $SiO_2$ (%) | 35.7 | 34.8 | 35.3 | 35.2 |
| $Al_2O_3$ (%) | 13.0 | 13.9 | 13.7 | 14.7 |
| CaO (%) | 36.8 | 37.5 | 38.3 | 38.6 |
| MgO (%) | 8.0 | 8.5 | 8.0 | 7.8 |
| Temperature of Top gas (°C.) | 264 | 222 | 233 | 260 |
| $CO/CO_2$ ratio | 1.39 | 1.51 | 1.61 | 1.70 |
| Dust collected (Kg/Ton Pig Iron) | 38.2 | 18.2 | 9.66 | 6.4 |

The results of these tests indicate that there is a significant increase in the amount of pig iron production using sponge iron as part of the charge to the blast furnace. According to these tests, when feeding 35% sponge iron the pig iron production increases about 50% as compared to the case in which the feed to the blast furnace contains 0% sponge iron.

In addition, a substantial decrease in the amount of coke consumption is realized when feeding sponge iron to the blast furnace. The test results indicate that a decrease in coke consumption of about 30% is realized when feeding 35% sponge iron to the blast furnace.

The terms and expressions which have been employed are used as terms of description and not of limitation, and there is no intention in the use of such terms and expressions of excluding any equivalents of the features shown and described or portions thereof, it being recognized that various modifications are possible within the scope of the invention.

We claim:

1. In a method for the production of pig iron of a type in which a blast furnace is charged with a mixture of coke, iron ore and prereduced iron ore, the improvement which comprises using a prereduced iron ore having a metallization of 75% to 85% and a carbon content of 1.4 to 4.5 weight percent at least 80% by weight of which is in the form of ferric carbide.

2. A method according to claim 1 wherein the prereduced iron ore has a metallization of 75% to 80% and a carbon content of 3 to 4.5 weight percent.

3. A method according to claims 1 or 2 wherein at least 90% by weight of the carbon content is in the form of ferric carbide.

4. A method for the production of pig iron in a blast furnace which comprises the steps of feeding the blast furnace with a charge of up to 60% by weight sinter, up to 95% by weight lump ore and 5% to 35% by weight sponge iron wherein said sponge iron has a 75% to 85% metallization and a 1.4% to 4.5% by weight carbon content, reducing a portion of the charge with carbon monoxide gas produced in the hearth and bosh of the blast furnace and reducing any residual iron oxide in the sponge iron by ferric carbide present in the sponge iron.

5. A method according to claim 4 wherein the prereduced iron ore has a metallization of 75% to 80% and a carbon content of 3 to 4.5 weight percent.

6. A method according to claims 4 or 5 wherein at least 90% by weight of the carbon content is in the form of ferric carbide.

* * * * *